United States Patent [19]

Janutta et al.

[11] Patent Number: 4,607,607

[45] Date of Patent: Aug. 26, 1986

[54] APPARATUS FOR DRESSING GRINDING WHEELS

[75] Inventors: Reinhard Janutta, Geesthacht; Uwe Uhlig, Buchholz; Werner Redeker, Börnsen, all of Fed. Rep. of Germany

[73] Assignee: Hauni-Werke Körber & Co. KG, Hamburg, Fed. Rep. of Germany

[21] Appl. No.: 651,070

[22] Filed: Sep. 14, 1984

[30] Foreign Application Priority Data

Sep. 24, 1983 [DE] Fed. Rep. of Germany ..... 3334663

[51] Int. Cl.[4] ..... B24B 53/00

[52] U.S. Cl. ..... 125/11 CD; 51/166 T

[58] Field of Search ..... 51/166 T; 125/11 CD, 125/11 R

[56] References Cited

U.S. PATENT DOCUMENTS

| | | | |
|---|---|---|---|
| 1,011,461 | 12/1911 | Manning | 51/166 T |
| 2,926,651 | 3/1960 | Balsiger | 125/11 CD |
| 3,747,584 | 7/1973 | Kikuchi | 125/11 CD |
| 4,073,281 | 2/1978 | Asaeda | 125/11 CD |
| 4,274,231 | 6/1981 | Verega | 51/165.71 |
| 4,393,625 | 7/1983 | Bloch | 125/11 CD |

FOREIGN PATENT DOCUMENTS 465869 5/1937 United Kingdom ..... 125/11 CD

*Primary Examiner*—Harold D. Whitehead
*Attorney, Agent, or Firm*—Peter K. Kontler

[57] ABSTRACT

A grinding machine wherein a column supports a vertically movable holder for the spindle of a grinding wheel and the dressing apparatus is mounted on the holder. The dressing apparatus has a carriage disposed at a level above the grinding wheel and movable up and down radially of the grinding wheel. The carriage has a forward extension for a follower which supports a pivotable carrier for two parallel or nearly parallel spindles each of which carries one or more dressing tools. The carrier is pivotable relative to the follower between a first position in which the first dressing tool is ready to treat the working surface of the grinding wheel and a second position in which the second dressing tool is ready to treat the working surface. Separate motors are provided to move the follower along the carriage, to move the carriage along the holder, to drive the spindles for the dressing tools, as well as to pivot the carrier relative to the follower. The dressing tools have different profiles and the axial distance between such dressing tools can be a small fraction of the axial length of the grinding wheel. The axis of at least one dressing tool is inclined with reference to the axis of the grinding wheel.

15 Claims, 8 Drawing Figures

APPARATUS FOR DRESSING GRINDING WHEELS

BACKGROUND OF THE INVENTION

The present invention relates to apparatus for dressing the working surfaces of grinding wheels, particularly the working surfaces of grinding wheels in surface grinding and profile grinding machines. Still more particularly, the invention relates to dressing apparatus for numerically controlled and preferably fully automated treatment of the working surfaces of grinding wheels in grinding machines of the type wherein the holder for the grinding wheel is normally movable vertically up and down along an upright column of the frame or housing of the grinding machine and the dressing apparatus comprises several rotary dressing tools each of which is or can be designed to treat a different portion of the working surface. In such grinding machines, the dressing tools and/or the grinding wheel or wheels are normally movable relative to each other, not only in the axial direction but also radially of the grinding wheel or wheels.

It is already known to treat the working surface of the grinding wheel in a grinding machine by several tools of a dressing apparatus. For example, the grinding machine which is disclosed in U.S. Pat. No. 4,274,231 comprises a dressing apparatus with two coaxial grinding tools. The tools resemble discs which are mounted on the table of the grinding machine and are movable relative to the major part of the machine frame toward and away from positions of register with the working surface of the grinding wheel. The two dressing tools have different profiles so that each thereof can treat a differently configurated portion of the working surface. The axial spacing between the two dressing tools exceeds the axial length (thickness) of the grinding wheel. The table must be moved in parallelism with the axis of the spindle for the grinding wheel and the grinding wheel and its holder must be moved radially of the dressing tools in order to place a selected tool into material-removing engagement with a selected portion of the working surface on the grinding wheel. When the treatment of the selected portion or portions of the working surface by one of the dressing tools is completed, the table which supports the dressing tools is moved in the axial direction of the grinding wheel so as to place the other dressing tool into a position of registry with the selected portion or portions of the working surface, namely with that portion or with those portions of the working surface which cannot be properly treated, cannot be treated as satisfactorily or cannot be treated at all by the one dressing tool.

The patented grinding machine and its dressing apparatus exhibit a number of serious drawbacks. First of all, the dressing apparatus is normally located outside of the work treating area so that it occupies additional space on the base of the grinding machine. Secondly, when the need for the treatment of the working surface of a grinding wheel arises, the table with the dressing tools thereon must cover a substantial distance before the first dressing tool assumes a position in which its profile is properly positioned for treatment of one or more selected portions of the working surface of the grinding wheel. This contributes significantly to the down times of the grinding machine because each dressing operation consumes a rather long interval of time. The just described drawback of the patented grinding machine is especially serious when the grinding wheel or wheels are designed for the removal of material from bulky and heavy workpieces. An additional drawback of the patented grinding machine is that the distance between the two dressing tools exceeds the axial length of the grinding wheel so that the table which supports the dressing tools must be set in motion again when the treatment of the working surface by one of the tools is completed in order to move the other dressing tool to a position of registry with the working surface of the grinding wheel. This takes up additional amounts of time, especially since each acceleration or deceleration of the relatively heavy table takes up a reasonably long interval of time. Still another drawback of the patented apparatus is that, since the axes of the two dressing tools coincide, the versatility of the dressing apparatus is not entirely satisfactory because such mounting of the dressing tools does not permit for adequate treatment of complex or highly complex working surfaces on grinding wheels. The common axis of the dressing tools is parallel to the axis of the grinding wheel. This, too, reduces the versatility of the patented grinding machine and its dressing apparatus.

OBJECTS AND SUMMARY OF THE INVENTION

An object of the invention is to provide a novel and improved dressing apparatus which can be used in a wide variety of grinding machines as a superior substitute for heretofore known dressing apparatus.

A further object of the invention is to provide a dressing apparatus which is particularly suited for use in profile grinding machines and can be used for fully or partly automated treatment of the working surface or surfaces of one or more grinding wheels.

Another object of the invention is to provide a dressing apparatus which can treat very simple as well as complex or highly complex working surfaces with the same degree of precision and reproducibility.

An additional object of the invention is to provide a dressing apparatus which can be installed in existing grinding machines as a superior substitute for heretofore known dressing apparatus.

Still another object of the invention is to provide a dressing apparatus which occupies less space than a conventional dressing apparatus and which occupies space that is available anyway in presently known types of grinding machines.

An additional object of the invention is to provide a dressing apparatus whose inertia is a small fraction of the inertia of conventional grinding apparatus, which does not comprise any parts projecting outwardly beyond the general outline of the grinding machine, and which can complete the treatment of the working surface of a simple, complex or highly complex working surface within a small fraction of the time that is required for such operation by resorting to a conventional dressing apparatus.

Another object of the invention is to provide a novel and improved method of treating the working surface of a grinding wheel in a grinding machine in a time-saving manner and with a compact and simple but reliable and rugged dressing apparatus.

A further object of the invention is to provide novel and improved means for installing, supporting and guiding the improved dressing apparatus in a grinding machine.

A further object of the invention is to provide the dressing apparatus with a novel and improved arrangement of plural dressing tools and means for rotating such tools.

An additional object of the invention is to provide a dressing apparatus which is more economical then conventional dressing apparatus for the grinding wheels of surface grinding and/or other types of grinding machines.

The invention is embodied in a grinding machine which comprises a housing or frame, at least one grinding wheel having a working surface and being rotatably mounted on the housing, and a novel and improved wheel dressing apparatus comprising a carrier, a plurality of rotary spindles on the carrier, and at least one dressing tool on each spindle. In accordance with a feature of the invention, the carrier is pivotable about an axis which is at least substantially parallel to the axis of at least one of the dressing tools between a plurality of different angular positions in each of which a different dressing tool is ready for engagement with the working surface of a grinding wheel or in each of which a different dressing tool is ready to be engaged by or to engage a selected portion of the working surface of a grinding wheel. The housing preferably includes an upright column which defines a substantially vertical path, and a holder which is reciprocable along such path. The grinding wheel is rotatably mounted on the holder so as to be movable therewith substantially radially of the dressing tools. Each of the dressing tools preferably exhibits a different profile. This contributes to the versatility of the improved dressing apparatus. The grinding machine and/or the dressing apparatus further comprises means for effecting a movement between the grinding wheel and the carrier in the axial direction of the grinding wheel as well as means for effecting a movement between the grinding wheel and the carrier in the radial direction of the grinding wheel.

The pivot axis of the carrier is or can be parallel to the axes of both dressing tools, and the dressing apparatus preferably further comprises a reciprocable carriage for the carrier of dressing tools, guide means which defines for the carriage a track extending in the axial direction of the grinding wheel and support means for the guide means. Such support means is movable substantially radially of the grinding wheel and can be mounted on the aforementioned holder for the grinding wheel. In fact, the support means can constitute a portion of the holder so that such portion shares the vertical up and down movements of the holder along the column of the housing of the grinding machine.

The grinding machine or the dressing apparatus preferably further comprises means for pivoting the carrier between its different positions; such pivoting means preferably includes means for holding the carrier in a selected position in which a selected dressing tool is ready to treat the working surface of the grinding wheel. For example, the pivoting means can comprise a pneumatically or hydraulically operated motor.

Common drive means is preferably provided for rotating the tools relative to their carrier. Such drive means can comprise a prime mover which is reciprocable with the carriage, a variable-length shaft which is driven by the prime mover, and means for transmitting torque from the shaft to the tools. For example, the shaft can comprise a first portion which receives torque from the prime mover and a second portion which receives torque from the first portion and serves to drive the torque transmitting means. One of the two portions of the shaft is movable axially of but cannot rotate relative to the other portion of the shaft. For example, one of the portions can be axially movably but non-rotatably telescoped into the other portion of the shaft.

The axis of at least one of the dressing tools is or can be inclined with reference to the axis of the grinding wheel. For example, the axes of the one tool and of the grinding wheel can make an acute angle of between one or more minutes and ten degrees.

The improved dressing apparatus is especially suitable for the treatment of complex or highly complex grinding wheels, for example, grinding wheels with working surfaces having one or more circumferentially extending grooves flanked by surfaces which may but need not be exactly normal to the axis of the grinding wheel.

The novel features which are considered as characteristic of the invention are set forth in particular in the appended claims. The improved dressing apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
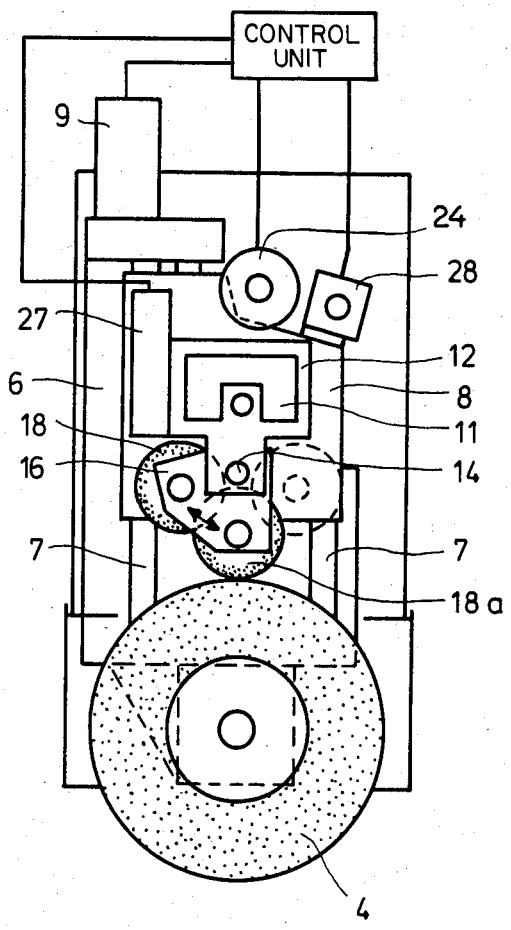
FIG. 1 is a front elevational view of a dressing apparatus which embodies one form of the present invention.
Figure 2:
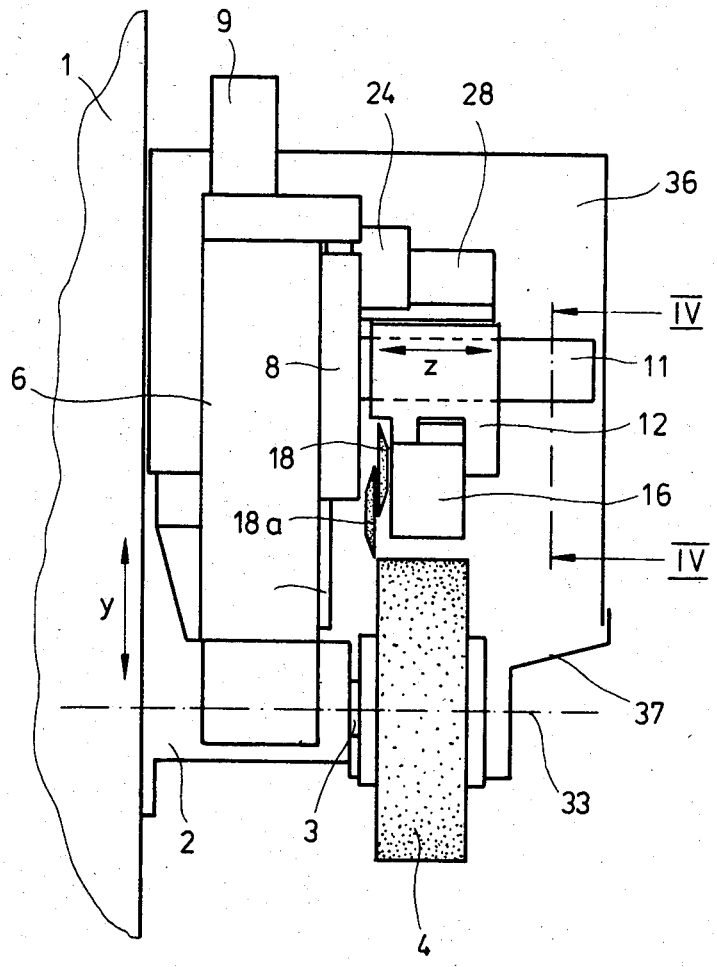
FIG. 2 is a side elevational view of the dressing apparatus which is shown in FIG. 1.
Figure 5A:
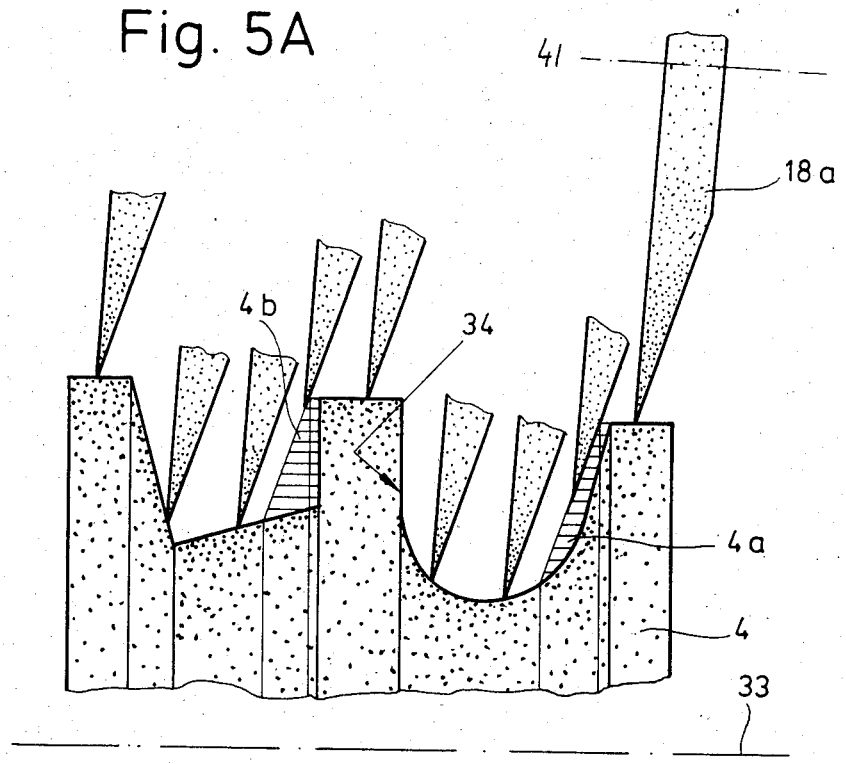
FIG. 5A is an enlarged fragmentary side elevational view of the grinding wheel, showing one of the dressing tools in a plurality of different positions during treatment of selected portions of the working surface.
Figure 5B:
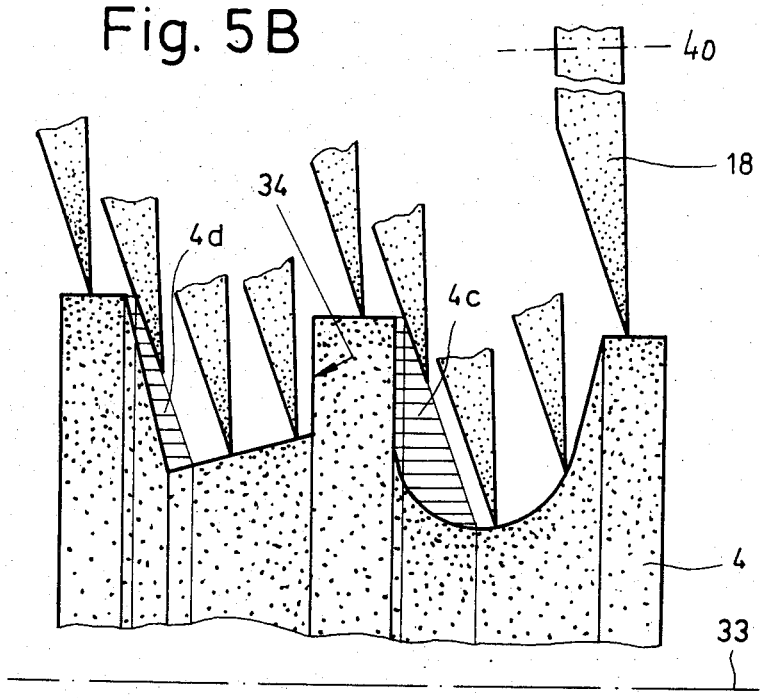
FIG. 5B shows the same part of the grinding wheel but during treatment of certain portions of its working surface by the other dressing tool of the improved dressing apparatus.

FIGS. 1 and 2 illustrate a dressing apparatus which embodies one form of the invention and comprises two differently profiled rotary disc-shaped dressing tools 18 and 18*a*. FIG. 2 further shows an upright column 1 which forms part of the housing or frame of a grinding machine and supports a holder 2 for the spindle 3 of a rotary grinding wheel 4. The holder 2 is reciprocable along the column 1 up and down in directions indicated by the arrow Y. FIG. 2 shows a simple grinding wheel 4 with a cylindrical working surface; however, the improved dressing apparatus can be used for the treatment of grinding wheels having much more complex working surfaces such as that of the grinding wheel 4 which is shown in FIGS. 5A and 5B.

In accordance with a feature of the invention, a support 6 for the dressing apparatus is mounted directly on the holder 2 for the spindle 3 of the grinding wheel 4. In other words, the support 6 and the entire dressing apparatus share all movements of the holder 2 in the directions which are indicated by the arrow Y. The support 6 is provided with or includes vertical guide means 7 for a carriage 8 which is movable relative to the holder 2 in the directions indicated by the arrow Y, namely in directions to move the dressing tools 18 and **18*a* nearer to or further away from the working surface of the grinding wheel 4. The drive means for moving the carriage 8 along the guide means 7 is shown at 9. Such drive means can comprise a reversible electric motor and a vertical feed screw (not specifically shown) which meshes with a nut provided on the carriage 8** so that the carriage moves up or down, depending on the direction of rotation of the motor which drives the feed screw.

The front side of the carriage 8 is provided with a horizontal beam-shaped extension 11 which extends at right angles to the guide means 7 for the carriage 8 and supports a follower 12 for movement in directions indicated by the arrow Z (see FIG. 2). Thus, when the follower 12 and the dressing tools 18, **18*a* move along the extension 11, either of the two dressing tools can be moved to a position of register with a selected portion of the working surface, as considered in the axial direction of the grinding wheel 4. The path of movement of the follower 12 is parallel or at least substantially parallel to the common axis of the spindle 3 and grinding wheel 4**.

Figure 4:
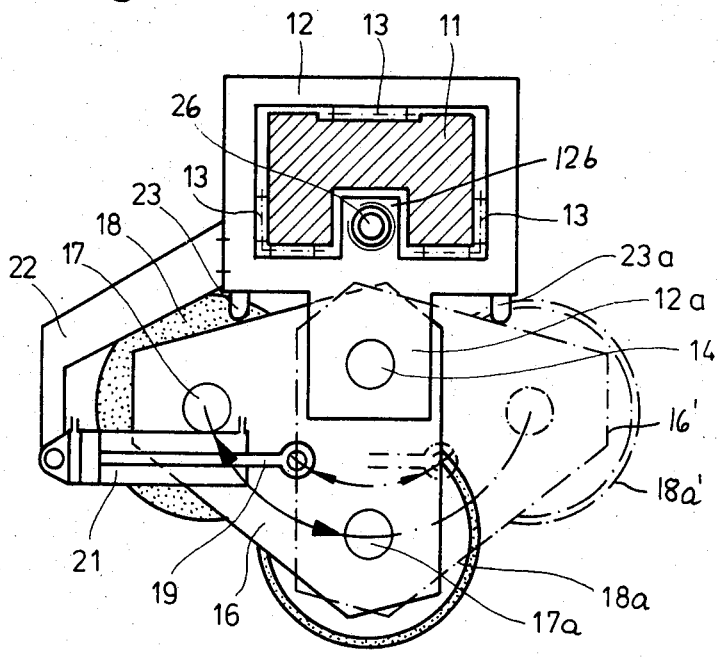
FIG. 4 is an enlarged front elevational view of the mechanism which pivots the carrier of dressing tools between several positions, substantially as seen in the direction of arrows from the line IV—IV of FIG. 2.

The manner in which the follower 12 is movable along the guide 11 is best shown in FIG. 4. The follower 12 is a hollow frame shaped structure which surrounds a portion of the extension 11 and is mounted on several sets of antifriction roller bearings 13 which are interposed between the parts 11 and 12. The means for reciprocating the follower 12 along the guide 11 comprises a reversible motor 24 which is mounted on the carriage 8 and a feed screw 26 which receives motion from the motor 24 and meshes with a nut **12*b* of the follower 12. Thus, by the simple expedient of reversing the direction of rotation of the motor of the reciprocating means 24, the follower 12 can be caused to move toward or away from the carriage 8 and more specifically toward and away from the guide means 7 on the support 6 for the carriage 8**.

The follower 12 further comprises a downwardly projecting portion or leg **12*a* which carries a horizontal pivot member 14 extending in parallelism with the spindle 3 for the grinding wheel 4 and in at least substantial parallelism with at least one of the spindles 17, 17*a* for the respective dressing tools 18, 18*a*. The pivot member 14 supports a swingable carrier 16 for the spindles 17 and 17*a*. The underside of the follower 12 has two spaced-apart stops in the form of studs 23 and 23*a* each of which can arrest the carrier 16 in one of two different angular positions. One such angular position is shown in FIG. 4 by solid lines; when the carrier 16 abuts against the stop 23, the dressing tool 18*a* is ready to treat one or more selected portions of the working surface of the grinding wheel 4. If the carrier 16 is thereupon pivoted to the phantom-line position 16' of FIG. 4 so that it abuts against the stop 23*a* of the follower 11, the dressing tool 18*a* is out of the way (in the position 18*a*') but the dressing tool 18 is ready to engage and treat one or more selected portions of the working surface of the grinding wheel 4**.

The means for pivoting the carrier 16 between the solid-line and phantom-line positions of FIG. 4 comprises a fluid-operated motor including a double-acting cylinder 21 which is pivotably mounted on an arm 22 of the follower 12 and a piston rod 19 which is articulately connected to the carrier 16. This system of valves which control the flow of a pressurized hydraulic of pneumatic fluid into and from the chamber of the cylinder 21 is shown at 27 in FIG. 1. The valve or valves which regulate the flow of fluid from the chambers of the cylinder 21 preferably receive signals from the numerical control system for the grinding machine in which the improved dressing apparatus is installed.

The various drives of the improved dressing apparatus preferably employ toothed belts in order to reduce the likelihood of slippage. For example, the output element of the aforementioned motor of the means 24 for reciprocating the follower 12 longitudinally of the extension 11 can comprise a set of pulleys and one or more endless toothed belts which transmit torque from the output element of the motor of 24 to the feed screw 26.

Figure 3A:
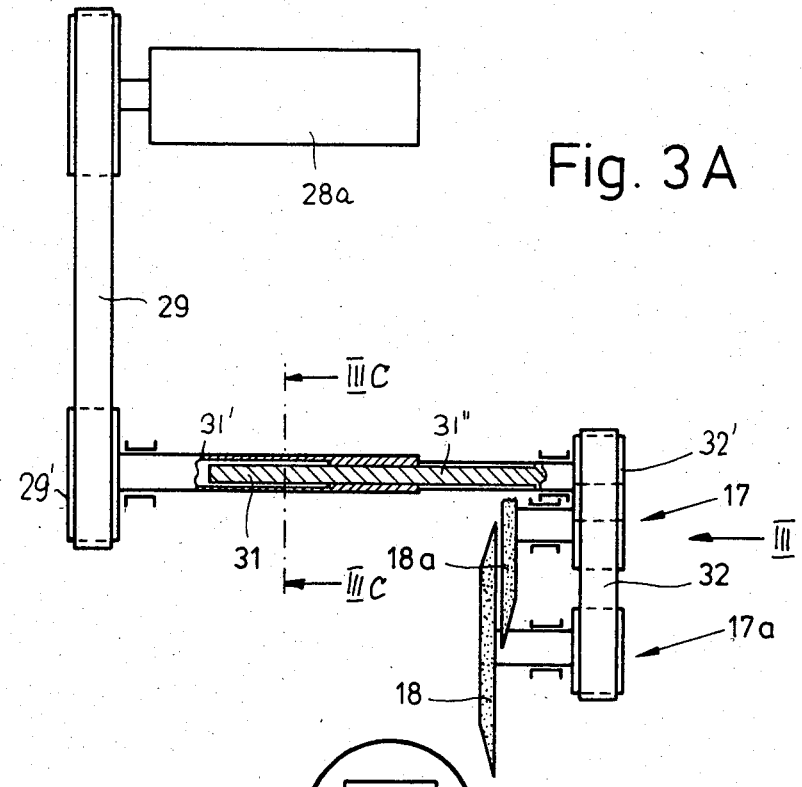
FIG. 3A is an enlarged schematic partly side elevational and partly sectional view of the means for rotating the tools of the improved dressing apparatus.
Figure 3B:
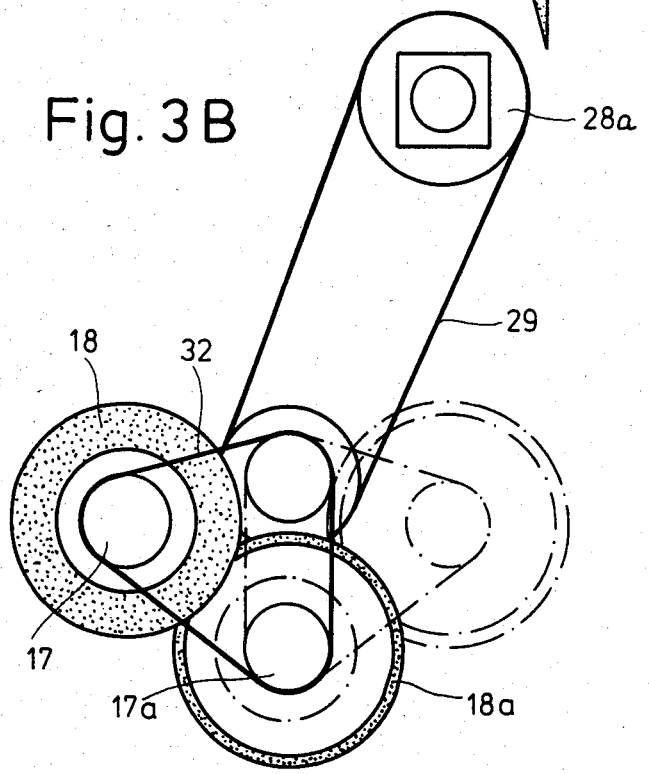
FIG. 3B is a front elevational view of the structure which is shown in FIG. 3A as seen in the direction of the arrow III.
Figure 3C:
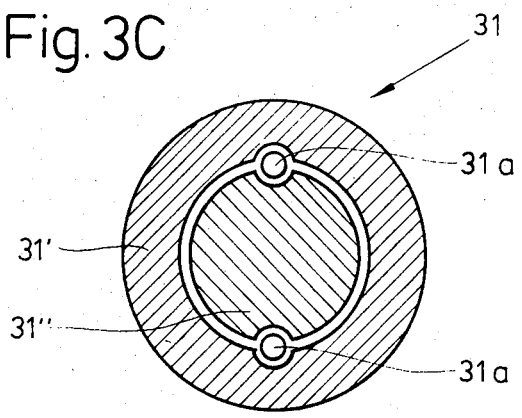
FIG. 3C ia an enlarged transverse sectional view as seen in the direction of arrows from the line IIIC—IIIC in FIG. 3A.

The means for rotating the spindles 17 and **17*a* for the respective dressing tools 18 and 18*a* is shown schematically at 28 (see the upper portion of FIG. 1 or 2). The details of one presently preferred embodiment of the means for transmitting motion from the prime mover 28*a* of the drive means 28 to the spindles 17 and 17*a* of the dressing tools 18 and 18*a* is shown in FIGS. 3A, 3B and 3C. The output element of the motor 28*a* drives a pulley 29' which receives torque from an endless toothed belt 29. The pulley 29' is rigidly connected with a hollow first portion 31' of a variable-length shaft 31 which transmits torque from the pulley 29' of FIG. 3A to the pulley 32' shown in the right-hand portion of FIG. 3A. The pulley 32' drives a second endless toothed belt 32 which is further trained over pulleys connected to or made integral with the respective spindles 17 and 17'. Thus, when the motor 28*a* is on, the belt 29 transmits torque to the shaft portion 31', and the shaft portion 31' transmits torque to a second shaft portion 31'' which, in turn, transmits torque to the pulley 32' for the belt 32 which drives the spindles 17 and 17*a*. As shown in FIG. 3C, the second portion 31'' of the variable-length shaft 31 is a solid cylinder which is axially movably but non-rotatably telescoped into the hollow portion 31' of the shaft 31. The means for preventing rotation of the shaft portions 31', 31'' relative to each other comprises two rows of spherical rolling elements 31*a* which are installed in registering longitudinally extending grooves machined into the peripheral surface of the shaft portion 31'' on the one hand and into the internal surface of the shaft portion 31' on the other hand. An advantage of the illustrated variable-length shaft 31 is that its portion 31'' need not extend forwardly beyond the pulley 32' and outwardly beyond the spindles 17 and 17*a*. The rolling elements 31*a* ensure that a minimal effort is required to move the shaft portion 31'' axially relative to the shaft portion 31' when the follower 12 is caused to move along the extension 11 of the carriage 8. The shaft portion 31'' shares the movements of the follower 12 relative to the extension 11. The axis of the shaft 31 is parallel to the axis of the grinding wheel 4**.

It is clear that the structure which is shown in FIGS. 3A, 3B and 3C constitutes but one of a wide variety of variable-length shafts which can be used in the improved dressing apparatus to transmit torque from the prime mover 28*a* to the spindles 17 and 17*a* while such spindles share the movements of the follower 12 along the extension 11 of the carriage 8.

The mode of operation of the improved dressing apparatus and of the grinding machine which embodies such apparatus will be described with reference to FIG. 4 as well as with FIGS. 5A and 5B showing a rather complex working surface of a grinding wheel 4 which can be treated by the dressing tools 17 and 17*a*. As can be readily seen in the drawing, each of the two dressing tools has a circumferentially complete marginal portion which resembles a cutting edge and has a wedge-shaped cross-sectional outline. Such configuration of the dressing tools has been found to be particularly suited for the treatment of working surfaces which exhibit grooves flanked by surfaces that may but need not be normal to the axis 33 of the grinding wheel 4.

It is now assumed that the carrier 16 is held by the piston rod 19 in the solid-line position of FIG. 4 so that it abuts against the stop 23 at the underside of the follower 12. This means that the dressing tool 18*a* is ready for treatment of selected portions (including those shown at 4*c* and 4*d* in FIG. 5B) of the working surface of the grinding wheel 4. The motor of the reciprocating means 24 is caused to rotate the feed screw 26 in a direction to move the follower 12 longitudinally of the extension 11 until the dressing tool 18*a* is in register with a selected portion of the working surface of the grinding wheel 4. The motor of 24 receives signals from the numerical controls of the grinding machine, the same as the motor of the drive 9 which moves the carriage 8 along the guide means 7 so that the dressing tool 18*a* treats the selected portion or portions of the working surface of the grinding wheel 4 in accordance with a preselected program. In other words, the motors of 9 and 24 cooperate to move the dressing tool 18*a* in one of the directions indicated by the arrow Y and in one of the directions indicated by the arrow Z in order to treat one or more selected portions of the working surface on the grinding wheel 4. FIG. 5A shows that the dressing tool 18*a* cannot treat or cannot properly treat those portions or sections of the working surface of the grinding wheel 4 which are indicated by the characters 4*a* and 4*b*. However, the dressing tool 18*a* can treat the sections or portions 4C, 4D which cannot be treated by the dressing tool 18 or which cannot be treated by the tool 18 with the same degree of accuracy and predictability as by the dressing tool 18*a*.

FIGS. 5A and 5B show that the axes 40 and 41 of the respective dressing tools 18, 18*a* are slightly inclined (in opposite directions) with reference to the axis 33 of the grinding wheel 4. The extent to which the axes 40, 41 are inclined relative to the axis 33 is relatively small; for example, the angle between the axes and 40,41 and the axis 33 can be in the range of between a few minutes and up to two ten degrees. An acute angle of approximately two to five degrees has been found to be quite satisfactory. Such small inclination of the dressing tools 18 and 18*a* enables the marginal portions of the dressing tools to properly treat all or nearly all portions of the working surface including the radially extending flanks 34 one of which is shown in each of FIGS. 5A and 5B. Such flanks are not treated by the major surfaces but rather by the marginal portions of the respective dressing tools. This contributes significantly to the accuracy of the dressing operation. The possibility of mounting the dressing tools 18 and 18*a* in such a way that their axes 40 and 41 are inclined with reference to the axis 33 of the grinding wheel 4 is attributable to the feature that the spindles 17 and 17*a* of the two dressing tools are discrete elements which are mounted on and are pivotable with a common carrier 14.

When the treatment of the selected portion or portions of the working surface of the grinding wheel 4 by the dressing tool 18*a* is completed, the numerical controls transmit appropriate signals to the system 27 which causes the double-acting cylinder 21 of the means for pivoting the carrier 14 to move such carrier to the phantom-line position 16′ of FIG. 4 and to place the dressing tool 18 into proper position for treatment of one or more selected portions (such as the portions 4*a* and 4*b* shown in FIG. 5A) of the working surface of the grinding wheel 4. The carrier 16 then abuts against the stop 32*a* of the follower 12 and one of the chambers in the cylinder 21 is filled with pressurized fluid so as to ensure that the piston rod 19 maintains the carrier 16 in the phantom-line position 16′ of FIG. 4 as long as is necessary to complete the treatment of the working surface of the grinding wheel 4 by the dressing tool 18. This completes the treatment of the working surface so that the grinding wheel 4 is ready to be used for removal of material from one or more workpieces on the bed of the grinding machine. In fact, and since the dressing apparatus is installed at a level above the grinding wheel 4, the latter can continue to treat the workpieces in the course of a dressing operation.

It will be seen that the working surface of the grinding wheel 4 which is shown in FIGS. 5A and 5B is rather complex. Nevertheless, such surface can be readily dressed by the tools 18 and 18*a* in any desired sequence which can be selected by the numerical controls so as to ensure that the dressing operation is completed within the shortest possible interval of time. The dressing operation is highly accurate, predictable and reproducible. Moreover, the entire dressing apparatus is very compact and occupies space (in front of the holder 2 for the spindle 3 and grinding wheel 4) which is available anyway. This dressing apparatus need not occupy any space on the bed of the grinding machine. It has been found that the improved dressing apparatus can complete the treatment of a simple, complex or highly complex working surface within a small fraction of the time which is required for such operation by utilizing a conventional dressing apparatus.

Referring again to FIG. 2, at least a portion of the dressing apparatus can be confined in a casing or enclosure including two separable portions 36 and 37. For example, the portion 36 can be lifted off the portion 37 so as to afford access to the component parts of the dressing apparatus. Furthermore, at least a portion of the casing including the parts 37 and 36 can be made of light-transmitting material so as to allow for continuous observation of the dressing operation when the dressing apparatus is in actual use.

The improved apparatus can comprise more than two dressing tools and a corresponding number of spindles on the carrier 16. The motor including the cylinder 21 and piston rod 19 or an analogous structure is then designed to pivot the carrier 16 between three or more different positions in each of which a different dressing tool is ready to treat one or more selected portions of the working surface on a grinding wheel. Furthermore, at least one of the spindles 17, 17*a* can support two or more axially spaced or closely adjacent coaxial dressing tools so that a relatively small number of spindles can support a substantial number of dressing tools each of which is preferably profiled to treat a specific portion of the working surface.

An important advantage of the improved dressing apparatus is that its tools 18 and 18*a* are not rotatable about a common axis. This is desirable and advantageous because the transition from treatment with the tool 18 to treatment with the tool 18*a* can be carried out by the simple expedient of pivoting the carrier 16 from the solid-position to the phantom-line position 16' of FIG. 4 or vice versa. In other words, it is not necessary to move the entire dressing apparatus in the axial direction of the grinding wheel 4 in order to shift from treatment with the dressing wheel 18 to treatment with the dressing wheel 18*a* or vice versa. This contributes significantly to a reduction of the overall time which is necessary to complete the dressing operation. Furthermore, the mass of the improved dressing apparatus is negligible in comparison with the mass of conventional dressing apparatus so that the carrier 16 can be rapidly accelerated to complete its pivoting from the one to the other position relative to the follower 12. As mentioned above, the apparatus which is disclosed in U.S. Pat. No. 4,274,231 comprises a table which carries a common spindle for the two dressing tools, and such table must share all movements of the dressing tools relative to the grinding wheel.

While it is also possible to install a carrier 16 on the base or bed of a grinding machine and to move it in the axial direction of the grinding wheel so as to place the dressing tool 18 or 18*a* to proper position for the treatment of one or more selected portions of the working surface, the mounting of the entire dressing apparatus on the holder 2 for the spindle 3 is preferred at this time because such mounting ensures that the dressing apparatus does not occupy any space on the base of the grinding machine. The just described mounting of the dressing apparatus on the holder 2 in such a way that the dressing tools 18 and 18*a* are movable in the axial direction of the grinding wheel 4 as well as radially of the grinding wheel has been found to contribute significantly to compactness of the dressing apparatus as well as to a shortening of the interval which is required to complete a dressing operation.

As mentioned above, the entire dressing apparatus is or can be mounted on the holder 2 at a level above the grinding wheel 4. This also contributes to compactness of the grinding machine because the dressing apparatus occupies space which is available anyway. Furthermore, and as also mentioned above, it is even possible to treat the working surface of the grinding wheel 4 while the latter is in actual contact with a workpiece.

The fluid-operated motor including the cyliner 21 and piston rod 19 has been found to be particularly suited for pivoting the carrier 16 to as well as for holding this carrier in selected angular positions. However it is also possible to employ other types of pivoting means, for example, electromagnetic pivoting means of any known design.

In order to enhance the compactness of the dressing apparatus, the spindles 17 and 17*a* can be placed close or very close to each other. Staggering of the spindles 17 and 17*a* in such a way that the axes 40 and 41 of the two dressing tools do not coincide brings about the advantages which were pointed out in connection with FIGS. 5A and 5B. Thus, this contributes to greater versatility of the improved dressing apparatus.

The provision of a common drive for the spindles 17 and 17*a* also contributes to simplicity and compactness of the improved dressing apparatus. As described above in connection with FIGS. 3A–3C, a single variable-length shaft suffices to ensure the transmission of torque from a single prime mover to the spindles 17 and 17*a* in such a way that no shafts or analogous rotary parts extend forwardly beyond the spindles 17 and 17*a*. The effective length of the shaft 31 varies automatically in response to movement of the follower 12 along the extension 11 of the carriage 8. In many heretofore known apparatus, portions of shafts, spindles or other rotating parts extend forwardly, especially when the dressing tool or tools are retracted from positions of register with the grinding wheel.

It is clear that the axes 40 and 41 need not be inclined with reference to the axis 33 of the grinding wheel 4. However, a slight inclination of the dressing tools relative to the grinding wheel brings about many advantages, especially when the working surface of the grinding wheel is complex or highly complex so that it could not be properly treated by dressing tools rotating about axes which are parallel with the axis of the grinding wheel. It is equally within the purview of the invention to make the axis 40 and 41 parallel to the axis 33 and to incline only the other axis.

All in all, the improved dressing apparatus ensures highly accurate and reproducible treatment of simple, complex or very complex working surfaces on grinding wheels, either while the grinding wheels are in actual use or during intervals between treatments of successive workpieces. Such advantages of the improved dressing apparatus are attributable, at least to a certain extent, to the provision of discrete spindles for two or more dressing tools and to such mounting of at least one of the spindles for the dressing tools that its axis is inclined with reference to the axis of the grinding wheel. The distance between the dressing tools 18 and 18*a* need not exceed the axial length of the grinding wheel as in the aforementioned patented grinding machine. This also contributes to a reduction of the time which is necessary to complete the dressing operation because it is not necessary to move the dressing tools through a considerable distance subsequent to completion of treatment with one dressing tool but prior to start of treatment with the other dressing tool. The compact dressing apparatus of the present invention contributes to compactness of the entire grinding machine.

Since the dressing apparatus is or can be mounted on the holder 2 for the vertically movable spindle 3 which carries and transmits torque to the grinding wheel 4, the grinding machine which employs such dressing apparatus need not necessarily be provided with a movable table at a level below the grinding wheel if the nature of treatment of workpieces is such that the workpieces need not be shifted relative to the grinding wheel while the latter is rotated and removes material from a workpiece. In other words, even though the grinding machine employs a highly satisfactory and versatile dressing apparatus, it need not be provided with a movable table or carriage below the grinding wheel for the specific purpose of transmitting motion to one or more dressing tools. Even if the grinding machine employs or must employ a movable table at a level below the grinding wheel, the extent to which such table is movable is controlled only by the nature of treatment to which the workpieces on the table are to be subjected and not by the requirement to use the table for moving one or more dressing tools to proper positions with reference to the working surface of the grinding wheel. This also contributes to compactness of the grinding machine because the extent to which the table or tables below the grinding wheel are movable can be reduced to a minimum since it need not be determined or influenced in any way by the fact that the grinding machine is equipped with a dressing apparatus.

Without further analysis, the foregoing will so fully reveal the gist of the present invention that others can, by applying current knowledge, readily adapt it to various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a grinding machine, the combination of a housing; a holder reciprocably mounted in said housing; a grinding wheel having a working surface and being rotatably mounted on said holder; and a numerically controlled dressing apparatus comprising a carrier movably mounted on said support, a plurality of rotary spindles of said carrier, at least one dressing tool on each of said spindles, at least one of said tools having a circumferentially complete marginal portion resembling a cutting edge and said carrier being pivotable about an axis which is at least substantially parallel to the axis of at least one of said dressing tools between a plurality of different angular positions in each of which a different tool is ready for engagement with said working surface, drive means for rotating said tools relative to said carrier, and means for effecting a movement between said carrier and said grinding wheel in the axial and radial directions of the grinding wheel.

2. The structure of claim 1, wherein said housing includes a column defining a substantially vertical path and said holder is reciprocable along such path.

3. The structure of claim 1, wherein said tools have different profiles.

4. The structure of claim 1, wherein the pivot axis of said carrier is at least substantially parallel to the axes of said tools and further comprising a reciprocable carriage for said carrier, said support including guide means defining for said carriage a track extending in the radial direction of said grinding wheel, said carriage being movable substantially radially of said grinding wheel and said means for effecting a movement between said grinding wheel and said carrier in the radial direction of said grinding wheel comprising means for moving said carriage along said guide means.

5. The structure of claim 4, further comprising follower means mounted on and movable relative to said carriage in parallelism with the axis of said grinding wheel, said means for effecting a movement between said grinding wheel and said carrier in the axial direction of said grinding wheel comprising means for reciprocating said follower means.

6. The structure of claim 5, wherein said housing comprises a column and said holder is reciprocable relative to said column along a substantially vertical path.

7. The structure of claim 1, further comprising means for pivoting said carrier between said positions.

8. The structure of claim 7, wherein said pivoting means includes means for holding said carrier in a selected position.

9. The structure of claim 7, wherein said pivoting means comprises fluid-operated motor means.

10. The structure of claim 1, wherein said drive means comprises a common drive for said tools.

11. The structure of claim 10, further comprising a carriage for said carrier, said carriage being reciprocable radially of said grinding wheel and said common drive means comprising a prime mover reciprocable with said carriage, a variable-length shaft driven by said prime mover, and means for transmitting torque from said shaft to said tools.

12. The structure of claim 11, wherein said shaft comprises a first portion receiving torque from said prime mover and a second portion receiving torque from said first portion and arranged to drive said torque transmitting means, one of said portions being axially movably but non-rotatably telescoped into the other of said portions.

13. The structure of claim 1, wherein the axis of at least one of said tools is inclined with reference to the axis of said grinding wheel.

14. The structure of claim 13, wherein the axes of said one tool and said grinding wheel make an actute angle of between one minute and ten degrees.

15. The structure of claim 1, wherein said working surface has at least one groove.

* * * * *